US006021653A

United States Patent [19]

Pimpo

[11] Patent Number: 6,021,653

[45] Date of Patent: Feb. 8, 2000

[54] VARIABLE COMBINATION ALPHABETIC INDICIA PADLOCK

[76] Inventor: William Pimpo, 439 Cross Rd., Gurnee, Ill. 60031

[21] Appl. No.: 09/249,081

[22] Filed: Feb. 12, 1999

[51] Int. Cl.[7] ..... E05B 37/06; E05B 37/00

[52] U.S. Cl. ..... 70/26; 70/319; 70/DIG. 44

[58] Field of Search ..... 70/24, 25, 26, 70/312, 316, 319, DIG. 44, 315

[56] References Cited

U.S. PATENT DOCUMENTS

| | | | |
|---|---|---|---|
| 752,020 | 2/1904 | Anderson | 70/26 |
| 839,333 | 12/1906 | Stolt | 70/26 |
| 967,466 | 8/1910 | Trierweiler | 70/26 |
| 1,195,745 | 8/1916 | Snyder | 70/26 |
| 1,497,810 | 6/1924 | Szutkowski | 70/26 |
| 1,580,573 | 4/1926 | Schara | 70/25 |
| 4,444,029 | 4/1984 | Remington | 70/312 |
| 5,715,709 | 2/1998 | Lai | 70/312 |

FOREIGN PATENT DOCUMENTS

| | | | |
|---|---|---|---|
| 2428415 | 2/1980 | France | 70/26 |
| 885365 | 8/1953 | Germany | 70/26 |
| 605018 | 7/1948 | United Kingdom | 70/25 |

*Primary Examiner*—Darnell M. Boucher
*Attorney, Agent, or Firm*—Peter Gibson

[57] ABSTRACT

The opening of a sliding shackle permits removal of a stack of individual dial type tumbler rings each may possess a number of individual peripherally disposed indicia plates which are removable from each tumbler ring so removed from the body of the padlock. Each tumbler is keyed to permit opening of the lugged shackle in only one rotational orientation of each tumbler. The indicia plates may be interchanged either with others already on that tumbler, another tumbler, or with other indicia plates altogether. Alphabetic as opposed to numeric indicia are suggested, either fixed directly to the tumbler rings or upon separate indicia plates, of which a large supply may be provided together with the padlock so that a large number of letter combinations are available for the padlock opening combination code which may be set by the owner to a desired code word. It is suggested that each indicia plate be slidably removable from the tumbler axially and that the padlock case enclose the sides of the tumbler rings so that the indicia cannot be moved unless the tumbler rings are removed from the padlock. It is also suggested that a bias be placed axially upon the stacked tumbler rings to prevent accidental dislodgement.

19 Claims, 2 Drawing Sheets

FIG 1
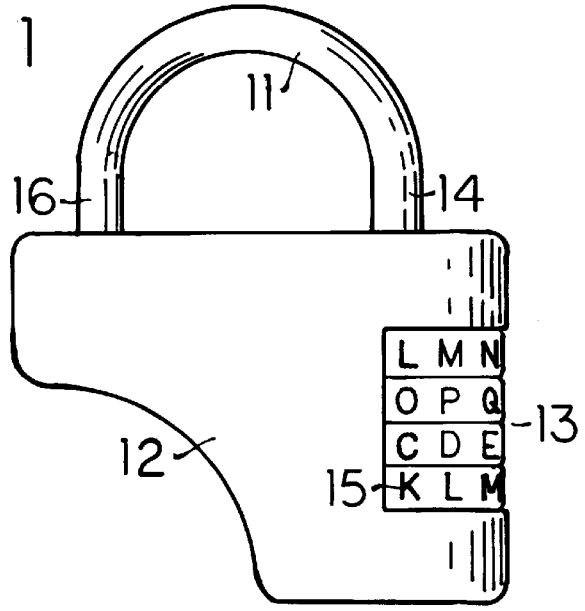
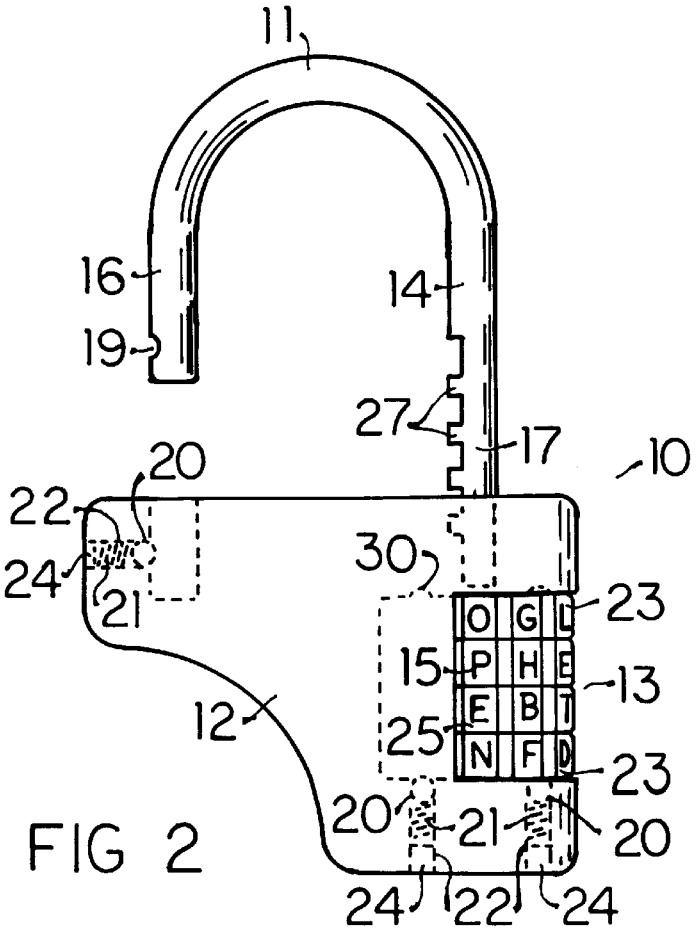
FIG 2

FIG 4
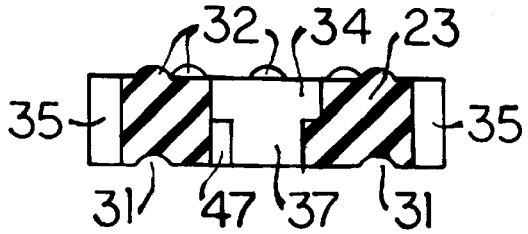
FIG 3
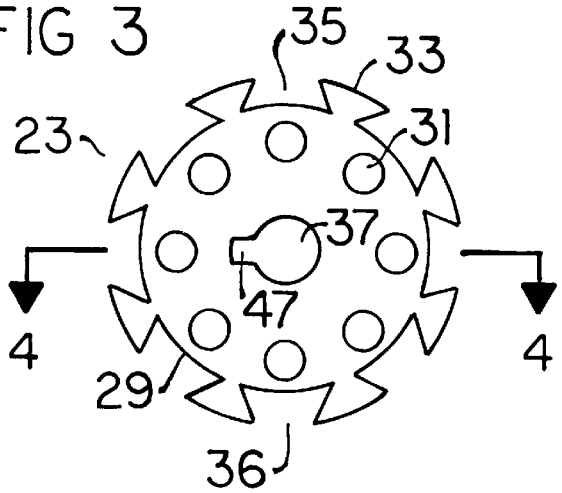
FIG 6
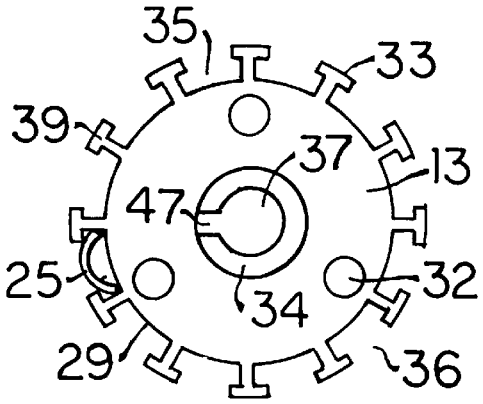
FIG 5
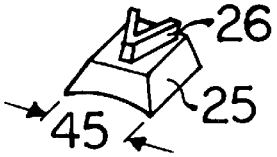
15 25
| | | | | | | | | | | | | |
|---|---|---|---|---|---|---|---|---|---|---|---|---|
| A | B | C | D | E | F | G | H | I | J | K | L | M |
| N | O | P | Q | R | S | T | U | V | W | X | Y | Z |
FIG 7

VARIABLE COMBINATION ALPHABETIC INDICIA PADLOCK

BACKGROUND OF THE INVENTION

1. Field of the Invention

The general field of the present invention is that of combination padlocks possessing a rigid, sliding, shackle, more particularly combination padlocks possessing a rigid, sliding, shackle further possessing tumbler rings and most specifically combination padlocks possessing a rigid, sliding, shackle further possessing a shackle and tumbler rings which are both removable from the padlock in order to permit permutation of the combination code utilized to open the lock.

2. General Background

Combination padlocks possessing a rigid, sliding, removable shackle and tumbler rings removable therefrom in order to permit permutation of the combination code are considered to be characterized by the utilization of a sleeve removable from the tumbler ring which has numerical indicia fixed peripherally and which may be rotated with respect to the tumbler ring in order to change the number corresponding to the rotational position of the tumbler ring which enables opening.

This arrangement enables selection of any desired numerical combination code comprised of the number of digits determined by the number of tumbler rings utilized. It is considered that transposition of tumbler rings sequentially enables permutation of the combination code for opening without use of numerically marked sleeves removable from the tumbler rings but that this only enables n factorial combination codes for opening. If, for example, four tumbler rings are utilized than 4×3×2=24 combination codes for opening are enabled while the use of rotational variable sleeves upon four tumbler rings allows $10^4$=10,000 possible combination codes for opening, assuming that all ten digits, i.e. 0–9, are present on each sleeve. The relative merit to being able to interpose tumbler rings as opposed to rotationally varying indicia position is hence considered small.

It is considered that numerical codes are more difficult to remember than words or combinations of letters, i.e. alphabetic characters, but that the use of tumbler rings or sleeves rotationally variable with respect to the tumbler rings cannot realistically contain all the letters of an alphabet. If each letter is given one quarter of an inch spacing upon the periphery of the ring or sleeve a circumference of 6.5 inches or a diameter exceeding two inches is required for accommodation of the English alphabet of twenty-six letters. This is considered to be ungainly and economically infeasible for an inexpensive padlock and explicative of why such a device is generally unknown.

Lacking any known padlock possessing a rigid, slidable, removable shackle demonstrating the use of letters, much less any such padlock permitting the selection of letters upon tumbler rings removable from the padlock for the purpose of selecting a particular combination of letters for the combination code opening the padlock the review of the known prior art below is representative of combination padlocks possessing a rigid, slidable, removable shackle permitting permutation of numeric indicia.

Discussion of the Prior Art

The below listed U.S. Patents are considered to be of pertinence to the present invention.

| U.S. Pat. No. | Inventor | Date | Title |
|---|---|---|---|
| 419,553 | Porter | Jan 14, 1890 | Permutation Padlock |
| 494,541 | Baron | April 4, 1893 | Permutation Padlock |
| 595,650 | Redman | Dec 14, 1897 | Combination Padlock |
| 1,551,952 | Hanflig | Sept 1, 1925 | Combination Lock |
| Re. 16,215 | Tobler | Nov 24, 1925 | Combination Lock |
| 1,924,987 | Furino | Aug 29, 1933 | Combination Lock |
| 4,615,191 | Grandy | Oct 7, 1986 | Barrel Combination Lock |
| 5,540,065 | Wyers | July 30, 1996 | Locking Device |

All of the patents listed above disclose combination padlocks with a rigid, sliding, removable shackle which further permits changing of the combination code utilized. Two broad groups are recognized, six earlier patents encompassing the years 1890–1933 and two recent patents issued in 1986 and 1996. The early patents cited may be considered as exhaustive of the variations upon a single basic structure wherein the shackle is retained by dial type rings in any position other than that aligning interior kerfs to permit shackle removal which action is necessary for removal and interposition of the rings permitting change of the combination code.

Porter engages both equal length legs of the shackle with a plurality of rings rotating about a cylindrical core which possesses a top central bolt to which a cap, bored through for each leg of the shackle, is attached to trap the rings. Baron uses rings mostly enclosed in a cylinder about one shank of the shackle mounted about an exteriorly splined internal sleeve using a notched interior rib which may be set in the bifurcated groove separating adjacent splines on the internal sleeve to permit rotational permutation. A leaf spring biases the sleeve outward to maintain the position of the rings after removal of the shank. Redman uses kerfed rings about either shank of the shackle each positioned rotationally and fixed to the shank by means of a set screw. The dial rings bearing external indicia are internally keyed and the keys align with the kerfs in the open position.

Hanflig uses a vertical stack of internally and externally kerfed discs inside the casing between the two legs of the shackle, each disc having a peripheral pattern of holes normal the disc faces into which pins are located extending either upward or downward. A bottom dial integral to a central keyed shaft is used to turn the discs in a sequence of opposed rotations to align the external kerfs for opening. Tobler uses central rings with opposed notches and slots and a stud protruding into an opening through the cylindrical casing which enables rotation of the ring through an arc in a direction aligning the notch determined by the position of the opposed groove which is changed by flipping the ring. The rings may be interposed and flipped to change the sequence of ring positioning which opens the lock. Furino uses an exposed vertical stack of dial rings each held by a leaf spring rotationally with respect to an externally keyed internal "locking ring". Partial displacement of the shackle while in the open position holds the locking rings in place thus permitting rotation of the dial rings relative to the locking rings.

The two more recent references cited, Grandy and Wyers, both disclose combination locks with rings engaging "clutches" about a central cylinder member. The rings may be rotated with respect to the clutches and interposed to permit setting of a new code. Both use caps to retain the assemblies which are held place by use of a pin. The former uses a spring loaded pin which cannot be pushed downward when the shackle is in place. The latter uses a simple pin pressure fitted into a collar which is presumedly of plastic.

Statement of Need

The above discussed prior art demonstrates a variety of means utilized to permit permutation of a combination padlock. The interposition of tumbler rings, flipping of the same, and rotational selection of the position of a dial ring utilized for opening are disclosed. It is considered to be assumed throughout the prior art that numerical indicia only are concerned as no provision is made to enable changing of the indicia upon a single dial ring; only changing all of the indicia in a fixed sequence upon a ring is utilized in the combination code determining opening. Without the ability to change the indicia upon a dial ring of a combination padlock the use of letters as indicia is considered to be severely restricted owing to the inability of changing individual indicia upon a single tumbler ring as well as to the previously discussed concern with accommodating all the letters of an alphabet upon a single ring.

It is also considered that the above discussed prior art reveals a central concern to combination padlocks with rigid, sliding, removable shackles that permit combination permutation with removal of the shackle and the tumbler rings: maintaining a given position of the rings when the shackle is removed. It is considered that the use of internal and external rings together with various other components is often more complex than is considered desirable with regard to both the number and the shape of the various components required.

It is therefore considered that a need hence exists for some means of enabling the changing of the indicia utilized upon a tumbler ring of a combination padlock in order to make the use of letters practical as indicia. A further need is recognized for a combination padlock possessing a rigid, sliding, removable shackle which allows combination permutation with removal of the shackle and the tumbler rings which maintains a given disposition of the tumbler rings when the shackle is removed which is simple, i.e. of few parts and of simply shaped parts.

SUMMARY OF THE INVENTION

Objects of the Invention

The primary objective of the principles relating to the present invention is the provision of a combination padlock with a rigid, sliding, removable shackle which permits permutation of the combination code determining opening with removal of the both the shackle and a plurality of tumbler rings which enables the use of letters as indicia upon the tumbler rings.

A secondary objective of the principles relating to the present invention is the provision of a combination padlock with a rigid, sliding, removable shackle which permits permutation of the combination code determining opening with removal of the both the shackle and a plurality of tumbler rings which maintains a given position of the tumbler rings with the shackle removed which is simple and economic.

Other objectives and advantages of the present invention may become apparent with an appreciation for the principles relating to the same set forth below.

Principles Relating to the Present Invention

The two objectives defined above are both pursued with a common approach to the basic structure of dial type tumbler rings: removable indicia plates, preferably each bearing one letter, are peripherally positioned about the perimeter of each of a plurality of tumbler rings. This structure permits, first, the selection of any given letter of the English alphabet of twenty-six letters for use in the combination code determining opening with dial tumbler rings bearing ten or less indicia which enables an economic size. This structure permits, secondarily, the permutation of the indicia selected for the combination code determining opening with dial tumbler rings constructed of a single piece which contact the shackle directly without the need for further internal or external rings or other intermediary or ancillary components with regard to locking of the shackle by the dial type tumbler rings.

In order to keep the dial tumbler rings in position with removal of the shackle it is suggested that a plurality of spring loaded ball bearings be utilized in a concentric pattern contacting and biasing an end dial tumbler ring. And it is further suggested that the face contacted have a plurality of semi-spherical concavities in a multiple of the same concentric pattern possessed of the spring loaded ball bearings.

The compression exerted by the spring loaded ball bearings will maintain the stack of dial type tumbler rings in position with removal of the shackle and will also provide registration or indexing of the biased end tumbler ring and all the other dial tumbler rings if each is possessed of a similar plurality of semi-spherical concavities upon the bottom face of the tumbler ring and further possessed of a congruent set of semi-spherical projections upon the top face in which case a uppermost set of semi-spherical concavities in a similar concentric pattern is desired upon the face of the body opposed to the outward face of the other end tumbler ring. Removal of the entire stack of the dial type tumbler rings is facilitated by this suggested structure of a concentric pattern of spring loaded ball bearings and the concentric pattern below the biased end tumbler ring. The entire stack of dial tumbler rings is rotated to a degree effecting an position of the semi-spherical concavities upon the bottom face of the bottom dial tumbler ring medial to the spring loaded ball bearings and the stack is pulled laterally out of the body of the padlock.

It is further noted that a balanced concentric pattern of spring loaded ball bearings is considered desirable wherein each said spring loaded ball bearing is equidistantly spaced apart from each other. The same aspect is obviously preferred for the multiple concentric patterns in which the semi-spherical concavities and the semi-spherical projections are disposed. In order to facilitate usage of numerical indicia it is recommended that the number of semi-spherical concavities or projections in these concentric patterns equal ten and that the number of spring loaded ball bearings number five. Alternatively, the use of three or four ball bearings and six, eight, nine or twelve semi-spherical concavities and projections in these concentric patterns is considered suitable if the indicia are letters only.

With regard to the preferred structure of the indicia plates and the means of retaining the same in, removing therefrom, and replacing into the peripheral locations upon the tumbler rings several approaches are considered. It is firstly considered that these indicia plates may be either flexible or rigid. If flexible the plates can have a thickness less than that of an undercut slotted cavity and a width greater than that of the cavity below the undercuts and will be retained in a compressed stated. If rigid indicia plates are utilized then it is suggested that either undercut slots be utilized which are only slightly greater in thickness and width than the indicia plates and further that the undercut slots and the rigid indicia plates have axially aligned edges angled inward from bottom to top so that the indicia plate is partially enclosed and thereby retained in position.

Secondly, since letters are desired as opposed to numbers, it is considered desirable to include a relatively large number of indicia plates. This concern suggests that the indicia plates be as economic as possible and stamping from sheet material is specifically suggested as an appropriate means of manufacture. Raised or relieved indicia as well as a broad range of shaping of the indicia plate is readily obtained in a single stamping operation although if beveled edges are desired a secondary operation would be required. Sheet material of either plastic or metal is considered suitable for stamping. Alternatively, injection molding, which requires thermoplastic as the material utilized, would also be an economic means of manufacturing any indicia plate configuration desired in a single operation, including raised or relieved indicia.

The overall construction of a padlock in accordance with the principles relating to the present invention, other than details relating to the above discussion, is considered to be conventional or known to one practiced in the art: a forged steel shank, preferably with a hardened surface is suggested; a body of solid construction preferably of non-corrosive metal such as brass or bronze is recommended with boring for the cavities required and closing of the same with interference fitted plugs; and a spring loaded ball bearing detent is recommended for providing a palpable indication of the closed position.

BRIEF DESCRIPTION OF THE DRAWINGS

FIG. 1 is a plain elevational view taken from the side of an embodiment of the principles relating to the present invention in the closed position.

FIG. 2 is a plain elevational view taken from the side of an embodiment of the principles relating to the present invention depicted in an open position with interior elements shown with dotted lines.

FIG. 3 is a plain elevation view taken axially of a dial type tumbler ring in accordance with the principles relating to the present invention.

FIG. 4 is a sectional view taken from FIG. 3.

FIG. 5 is an isometric view of an indicia plate in accordance with the principles relating to the present invention.

FIG. 6 is a plain elevation view taken axially of a dial type tumbler ring in accordance with the principles relating to the present invention.

FIG. 7 is a plain elevational view taken from the top of a plurality of indicia plates constructed from sheet material.

DETAILED DESCRIPTION OF A PREFERRED EMBODIMENT

A combination padlock 10 in accordance with the principles relating to the present invention is seen in a closed state in FIG. 1 wherein a rigid, sliding, removable shackle 11 is held within a rigid body 12 by a vertical stack of dial type tumbler rings 13 which are concentrically disposed about a long leg 14 of the shackle 11. Each tumbler ring possesses a plurality of indicia 15 peripherally disposed as seen. In this preferred embodiment the tumbler rings 13 each have alphabetic indicia 15 fixed directly to each of the tumbler rings 13 and a total of ten indicia 15 per tumbler ring 13 are depicted. Ten indicia 15 fixed peripherally to a dial type tumbler ring 13 is considered a typical arrangement upon combination padlocks because numerical indicia are invariably utilized and the digits 0–9 invariably represented. The use of alphabetic indicia 15 as depicted in FIGS. 1 & 2, whether peripherally fixed, as depicted in FIG. 1, or born by indicia plates 25 as depicted in FIG. 2, is considered to be a novel aspect to the present invention.

If alphabetic indicia 15 are embossed, engraved, printed, formed or otherwise fixed peripherally to the tumbler rings 13 it is suggested that additional tumbler rings 13 be provided beyond those required for operation of the padlock 10 in order to provide for a fuller range of the alphabet for each position within the stack of tumbler rings 13. Each tumbler ring 13 may be and is recommended in all cases to be identical in order to allow interposition of the same. In this respect the depiction of only four tumbler rings 13 and only ten indicia 15 upon each suggests what is considered as a restrictive case; only forty indicia 15 are available for use with any four given tumbler rings 13, but if only three such tumbler rings 13 were utilized there would still be thirty letters available, which exceed the number of letters in the English alphabet and is therefore considered perfectly adequate.

One of the objects of the present invention concerns education and it is desirable to present all the letters of an alphabet in the indicia 15 available, so that a child has an aid in learning the alphabet. It is mentioned in this regard that while only letters of the English alphabet commonly in use in the United States, Great Britain, and other English speaking countries, the Roman alphabet, from which the English alphabet derives, supports a much wider language base than just English. French, German, Spanish and Italian all utilize alphabets derived from the Roman and essentially identical to the English alphabet. And it is considered that other alphabets may also be conveyed by the indicia 15 utilized.

The padlock 10 depicted in FIG. 1 otherwise is considered to be the same as that depicted in FIG. 2 wherein the short leg 16 of the shackle 11 is seen to clear the body 12 of the padlock 10 when in an open state while the lower portion 17 of the long leg 14 remains within the body 12 and may be rotated within the same to swing the short leg 16 to a side in order to more readily permit either the removal or replacement of the two end links of a chain, not shown, or other structure encircling the shackle in use of the padlock 10. It is also mentioned that while only four tumbler rings 13 are depicted in FIGS. 1 & 2 the use of three, as mentioned above, or two, or five, or more tumbler rings 13 is considered to be feasible in the construction of a padlock 10 in accordance with the principles relating to the present invention.

As depicted in FIG. 2 the lower portion 17 of the long leg 14 of the shackle 11 is of a reduced diameter and, it is readily seen, that the dial type tumbler rings 13 are concentrically disposed about the same when the padlock 10 is in a closed state. The lugs 27 projecting radially from the reduced diameter of the lower portion 17 of the long leg 14 are, as seen in FIG. 2, spaced apart evenly from each other such that, when the padlock 10 is closed and locked by rotating the tumbler rings 13 a full diameter bore 34 in the upper half of each ring 13, 23, seen in FIGS. 4 & 6, accommodates one lug 27 so that the ring 13 may rotate freely about the lower portion 17 of the long leg 14 of the shackle 11 while the reduced diameter bore 37 in the lower half of each ring 13 traps the lug 27 concerned except in the position depicted in FIGS. 2, 3, 4 & 6 wherein a keyway 47 opening off from that reduced diameter bore 37 is aligned with the lugs 27 upon the lower portion 17 of the long leg 14 of the shackle 11.

In order to maintain the dial type tumbler rings 13 in position when the shackle 11 is removed sufficiently to clear the lower portion 17 of the long leg 14 from the stack of tumbler rings 13 a means of biasing the stack of tumbler rings 13 is required. In the preferred case this means of biasing is achieved with a plurality of ball detents arranged in a concentric pattern with respect to the axis of the stack of tumbler rings 13 which is furthermore, in the preferred embodiment shown, coincident with the axis of the reduced diameter of the lower portion 17 of the long leg 14 of the shackle 11, in contact with the outward face of an end tumbler ring 23. Each ball detent has a ball bearing 20 biased by a coil spring 21 under compression both held within a cylindrical cavity 22 with one open end through which the ball bearing 20 partially protrudes.

The other end is preferably sealed by a plug 24 which has an interference fit with the body 12. The interference fit may be effected with simple force, particularly if the plug 24 is of harder material than the body 12. Alternatively the plug 24, of slightly greater diameter than the cylindrical cavity 22 to be sealed, may be placed in a state of very low temperature in order to contract the diameter of the same, inserted into the cylindrical cavity 22 and allowed to assume ambient temperature resulting in expansion of the plug 24 in an the interference fit with the body 12 desired.

The outward face of an end tumbler ring 23, with respect to the stack of tumbler rings 13, and preferably one face of each tumbler ring 13, possesses a concentric pattern of semi-spherical concavities 31 equidistantly spaced from each other as shown in FIGS. 3 & 4. The pattern shown is a duplicate of that possessed by the ball bearings 20 contacting this end tumbler ring 23, which are four in number, and hence eight different rotational positions for each tumbler ring 13 is explicitly represented. It is understood that both the number of ball detents disposed in a concentric pattern in order to contact an end tumbler 23 may vary and the number of rotational positions possessed of each tumbler 13 may vary independently of or in accordance with the number of these ball bearings 20. If a form of registration is desired for each tumbler ring 13, 23, whereby distinct rotational positions of each tumbler ring 13 palpable to the operator is obtained, it is recommended that each tumbler ring 13, 23 possess a structure similar to that shown in FIGS. 3 & 4 wherein each rotational position is defined with mating patterns of semi-spherical concavities 31 and convexities 32.

In this case, wherein a concentric pattern of ball bearings 20 are biased against the outward surface of an end tumbler ring 23 and each tumbler ring 13, 23 has a concentric pattern of preferably semi-spherical concavities 31 and convexities 32 on opposed faces, each concentric pattern is preferably a multiple of the concentric pattern of ball bearings 20. Each such concentric pattern of concavities 31 and convexities 32 needn't be the same multiple but use of any pattern other than a multiple of that possessed by the ball bearings 20 will not enable registration of the tumbler rings 13 in aligned positions with each other.

In the case shown in FIGS. 3 & 4 the eight concavities 31 yield eight different positions palpable to the operator of that end ring 23, even if only four convexities 32 are used on the opposed face, if the adjacent tumbler ring 13 surface possesses eight concavities 31 in a duplicate pattern. Twelve positions are similarly obtainable from a concentric pattern of four ball bearings 20 biased against an outward surface of an end tumbler ring 23, or sixteen positions. Six, nine, twelve and fifteen positions are readily obtainable from a concentric pattern of three ball bearings 20 so biased. If ten positions are desired in order to accommodate the numerical indicia 0–9, five ball bearings 20 are required to obtain a balanced concentric pattern with equivalent arc or angles between ball bearings 20 which is considered highly desirable.

As seen in FIG. 6, it is considered that the number of convexities 32 may equal the number of ball bearings 20 utilized to axially bias the stack of tumbler rings 13 while the number of rotational positions utilized is a multiple of the same. In the case depicted in FIG. 6 three convexities 32, which assumes use of three spring 21 loaded ball bearings 20, yields twelve different rotational positions. The tumbler ring 13 depicted in FIG. 6 further differs from that shown in FIGS. 2–4 in having axially oriented dividers 39 projecting radially and defining axially aligned slots 35 therebetween.

Other means of biasing the stack of tumbler rings 13 from one end are feasible. A single coil spring of a diameter exceeding that of the reduced diameter of the lower portion 17 held in a state of compression against the outward face of an end tumbler ring 23 would provide an essentially equivalent structure effecting means of biasing the stack of tumbler rings 13 from one end. A plate interposed between the spring and the outward face of the end tumbler 23 biased might have a pattern of convexities 32 or concavities 31 which would further enable registration of the tumbler rings 13 as discussed above. The plate would have to float within a restricted range, not unlike the ball bearings 20 trapped in cylindrical cavities 22 with the open end possessing an opening of less than the diameter of the ball bearing 20 so that a portion of the same protrudes therefrom.

As seen in FIG. 2 another ball bearing 20 similarly biased by a coil spring 21 under compression trapped in a cylindrical cavity 22 preferably closed by a plug 24 in the manner discussed above is found in a perpendicular disposition with respect to the either the axis of the long leg 14 or the short leg 16 of the shackle 11 and in contact with a detent 19 proximate the free end of the latter when the shackle 11 is in a locked position. This arrangement yields a palpable positioning of the shackle 11 in the locked position wherein each lug 27 protruding perpendicularly from and with respect to the axis of the reduced diameter of the lower portion 17 of the long leg 14 of the shackle 11 is positioned axially with respect to the stack of tumbler rings 13, 23 to occupy the full diameter bore 34, seen in FIG. 4, of one said tumbler rings 13, 23.

Each tumbler ring 13,23 is thereby free to be rotated with the reduced diameter bore 37 of the tumbler ring 13, 23 revolving around the reduced diameter of the lower portion 17 of the long leg 14 of the shackle 11, displacing rotationally the keyway 47 from alignment with the lug 27. Alignment of each keyway 47 of each tumbler ring 13, 23 being then necessary for removal of the lower portion 17 of the long leg 14 of the shackle 11 from the stack of tumbler rings 13, 23 and said alignment defining the combination of rotational positions of each tumbler ring 13, 23 which opens the padlock 10.

The manner provided for changing of this combination is considered central to fulfillment of the principles relating to the present invention. Each tumbler ring 13, 23 preferably has, as best seen in FIGS. 3 & 6, a plurality of axially aligned slots 35 peripherally located upon each tumbler ring 13, 23 equidistantly spaced apart from each other in a concentric pattern radially aligned with the concentric pattern of semi-spherical concavities 31 discussed above. This radial alignment is not required for the registration discussed above for the rotational positioning of the tumbler rings 13,23 provided by these concavities 31. If the arc or angle between adjacent axially aligned slots 25 is equivalent to that between the concavities 31 consistent registration is assured even if the two respective concentric patterns are offset from each radially.

Each axially aligned slot 35 is adapted to permit insertion, retention, and removal of a suitably shaped indicia plate 25 after the tumbler ring 13 concerned has been removed from the padlock 10. Displacement of the tumbler rings 13, 23 from the padlock 10 is readily achieved after removal of the shackle 11 with a straight pull outward of the stack of tumbler rings 13 which outwardly displaces the means of axially biasing an end tumbler ring 32. In a preferred embodiment of the principles relating to the present invention each tumbler ring 13, 23 possesses a concentric pattern of preferably semi-spherical concavities 31 and convexities 32 upon opposed faces in order to facilitate registration of rotational positioning of each tumbler ring 13, 23 as discussed above.

It is further noted in this regard and with regard to the matter of removing the stack of tumbler rings 13 from the padlock 10 that said preferred embodiment further possesses a similar concentric pattern of concavities 30 upon the inward surface of the body 12 contacting the outward surface of the end tumbler ring 23 distal to the means of axially biasing the stack of tumbler rings 13 as represented in FIG. 2. This concentric pattern of concavities 30 is hence opposed to the concentric pattern of ball bearings 20 as shown in FIG. 2 and is further preferably a duplicate of that pattern of ball bearings 20 for the purpose of supporting registration of the end tumbler ring 23 distal that contacted by the means of axially biasing the stack of tumbler rings 13.

In addition to facilitating registration of that end tumbler ring 23 removal of the stack of tumbler rings 13 is further facilitated as the convexities 32 upon the surface of the end tumbler ring 23, rotated to a position intermediate the fixed concavities 30 upon the inward surface of the body 12 together with rotation of the other end tumbler ring 23, compresses the spring 21 loaded ball bearings 20 and allows removal of the stack of tumbler rings 13 from the body with a straight, radial, pull outward as mentioned earlier. This action of course must be preceded by removal of the shackle 11 to the extent necessary to clear the lower portion 17 of the long leg 14 over the stack of tumbler rings 13 which requires alignment of the keyways 47 of each tumbler ring 13,23 with the lugs 27 as described above.

After removal of the stack of tumbler rings 13 from the body 12 of the padlock 10 the individual indicia plates 25 on a given tumbler ring 13 are removable with displacement axially with respect to the tumbler ring 13, 23. As clearly depicted in FIG. 3 each axially aligned slot 35 possesses an interior tangent dimension exceeding that of the opening 36 of the slot 35 through the periphery 33 of the tumbler ring 13,23. The axially aligned slots 25 as seen in FIG. 3 possess a greater width between opposed sidewalls extending radially outward from a substantially flat floor 29 than possessed between opposed edges of the opening 36 at the periphery 30 of the tumbler ring 13. A suitably shaped indicia plate 25, such as that depicted in FIG. 5, is readily slid into, out of, the axially aligned slot 35 and is further retained by in the same preferably with a friction fit against the interior surfaces of the axially aligned slot 35. If the width 45 of the indicia plate 25, i.e. the measure taken tangent to the radius of the tumbler ring 13,23, is greater than the width of the opening 36 then the indicia plate 25 will be retained within the tumbler ring 13 after the stack of tumbler rings 13 is returned to the body 12 of the padlock 10.

As may be most clearly seen in FIG. 5, it is recommended that the indicia plates 25 possess a raised letter 26 which is intended to project slightly through the opening 36 of the axially aligned slot 35. It is intended that the slight projection of the raised letters 26 upon each indicia plate 25 will assist in manipulation of the rotational disposition of the tumbler ring 13 and that the letters selected for the combination code opening the padlock 10 may be palpably discerned. It is further commented that raised letters 26 particularly are considered to provide further reinforcement of the previously mentioned educational purpose in assisting a child to become acquainted with the alphabet. It is hoped that this educational aspect is also one which is inherently interesting to the child in relating to the mechanical operation of a padlock 10 with removable shackle 11, tumbler rings 13, 23, and indicia plates 25. It is emphasized, however, that the use of any alphabetic indicia 15, regardless of the language, is considered to provide an educational benefit, not only to children, but to anyone who prefers the use of letters as opposed to numbers. People suffering from dyslexia, for instance, might particularly appreciate this aspect.

The indicia plates 25 represented in FIG. 5 are presumed to be substantially rigid as no flexibility is required for insertion, retention, or removal from the axially aligned slot 35 depicted in FIG. 3. An alternative axially aligned slot is depicted in FIG. 6 which is suited to use in conjunction with either a substantially rigid or flexible indicia plate 25. As seen in FIG. 6, a plurality of T shaped axially aligned dividers 39 extend outward from the periphery 33 of the tumbler ring 13 each adapted to laterally confine a plurality of indicia plates 25. If these indicia plates 25 are substantially rigid then each possesses a concave bottom, a convex top, and each must be axially displaced with respect to a pair of axially aligned dividers 39. If these indicia plates 25 are flexible, however, then insertion may be effected by flexing the indicia plate 25 so that two parallel opposed edges may be each clear the sides of a pair of adjacent axially aligned dividers 39, then allowing the indicia plate 25 to expand into place between said dividers 39. It is further commented that use of a relatively flexible indicia plate 25, especially one without raised letters 26, facilitates the manufacture of the indicia plates 25 from a substantially uniform sheet material, as depicted in FIG. 7, without stamping of the sheet other than to provide scoring or perforation to facilitate separation of the individual indicia plates 25 for the sheet. The indicia 15 may be applied by printing.

In the interest of favoring the educational aspect and the interest a child might take in the padlock 10 it is considered desirable, as mentioned earlier, to provide a sufficiency of indicia plates 25 for the formulation of practically any word or other combination of alphabetic indicia or letters desired for use as the combination code opening the padlock 10. To this purpose it is considered that if four tumbler rings 13, 23 are utilized, as shown in FIGS. 1 & 2, four complete sets of the alphabet would be required to allow full latitude in achieving this objective. And it is also considered that a couple sets of the full alphabet would allow almost any four or five letter word to be selected as the combination code as a practical matter.

With this in mind two full sets of the English alphabet is depicted in FIG. 7 wherein a plurality of indicia plates 25 are shown to be stamped from sheet material and may be readily separated from the others. The indicia 15 may be printed upon the sheet material or may be embossed upon the same without forming, with either an open or closed form. Forming raised indicia 26, or indicia 15 which are relieved or engraved, from sheet material in an operation such as stamping is also readily feasible and considered practical. Forming with a closed mold such as required of injection molding is not deemed appropriate for sheet material though it is considered appropriate for forming of indicia plates 25 such as that depicted in FIG. 5.

While the foregoing is intended to provide one skilled in the art with what is considered the best manner known of making and using an embodiment of the principles relating to the present invention the same is not to be construed as in any manner restrictive of the scope of the invention or the rights and privileges to be obtained protecting the same by the granting of Letters Patent for which I do hereby claim:

1. A combination padlock intended to permit selection of a combination of alphabetic indicia as the combination code for opening, said padlock comprising:

a body, a shackle slidably displaceable with respect to said body, a plurality of dial type tumbler rings of substantially similar perimeter, and a plurality of indicia plates;

said shackle possessing a lower portion extendable through said plurality of tumbler rings arranged in a stack possessing two end tumbler rings each possessing an outward face adjacent an inward face of said body when each said tumbler ring is rotationally aligned about a common axis in an open position, said lower portion of said shackle being retained by each said tumbler ring in said stack not rotationally aligned in an open position;

said stack of tumbler rings being removable from said body when said lower end of said shackle is displaced a distance sufficient to clear said stack of tumbler rings;

each said tumbler ring possessing a plurality of axially aligned slots each peripherally disposed and adapted to permit both removal of one of said indicia plates and insertion of one of said indicia plates when said tumbler ring is isolated and to retain said indicia plate when said tumbler ring is within said stack;

whereby rotational alignment of said tumbler rings in said stack enclosed at either end by said body about a common axis in an open position permits removal of said lower portion of said shackle sufficient to clear said stack which permits removal of each of said plurality of tumbler rings from said stack and permits changing of the indicia plates peripherally disposed upon each said tumbler ring and a combination code associated with aligned indicia for opening said padlock.

2. The combination padlock of claim 1 wherein said indicia are alphabetic.

3. The combination padlock of claim 1 wherein each of said plurality of axially aligned slots possesses a peripheral opening of lesser width than an interior width possessed of said slot.

4. The combination padlock of claim 1 wherein said indicia plates are constructed from flexible sheet material.

5. The combination padlock of claim 4 wherein said indicia plates have indicia printed thereupon.

6. The combination padlock of claim 5 wherein said indicia plates possess raised indicia.

7. The combination padlock of claim 5 wherein said indicia plates are formed by a forming process such as stamping utilizing an open form.

8. The combination padlock of claim 5 wherein said indicia plates are formed by a molding process such as injection molding utilizing a closed mold.

9. The combination padlock of claim 1 wherein said shackle possesses a long leg which includes said lower portion extendable through said plurality of tumbler rings arranged in a stack with an end enclosed within said body and possesses a short leg with an end which is enclosed within said body when said lower portion is extended through said plurality of tumbler rings.

10. The combination padlock of claim 9 wherein said short leg possesses a detent contacted by a spring loaded ball bearing held within a cavity of said body.

11. The combination padlock of claim 10 wherein said cavity of said body is cylindrical and is closed by a plug possessing an interference fit with said body.

12. The combination padlock of claim 1 possessing means of axially biasing one of said end tumbler rings arranged in said stack possessing two end tumbler rings each possessing an outward face adjacent an inward face of said body.

13. The combination padlock of claim 12 wherein said means of biasing said stack axially includes at least one coil spring.

14. The combination padlock of claim 13 wherein said means of biasing said stack axially includes a plurality of ball bearings each biased by a coil spring arranged in a concentric pattern.

15. The combination padlock of claim 14 wherein said plurality of coil springs each biasing one said ball bearing are each held within a cylindrical cavity of said body closed by a plug possessing an interference fit with said body.

16. The combination padlock of claim 14 wherein said concentric pattern of spring loaded ball bearings is balanced with a substantially equal angle between adjacent ball bearings.

17. The combination padlock of claim 16 wherein the outward face of said end tumbler ring contacted by said means of axially biasing said tumbler rings in said stack possesses a concentric pattern of concavities which is a multiple of said concentric pattern of spring loaded ball bearings.

18. The combination padlock of claim 17 wherein each tumbler ring possesses a concentric pattern of concavities which is a multiple of said concentric pattern of spring loaded ball bearings upon one face and a similar concentric pattern of convexities upon the opposed face.

19. The combination padlock of claim 17 wherein said concavities and said convexities are both semi-spherical.

* * * * *